US010519716B2

(12) United States Patent
Saxby

(10) Patent No.: US 10,519,716 B2
(45) Date of Patent: Dec. 31, 2019

(54) LADDER SUPPORT ATTACHMENT

(71) Applicant: George Saxby, Regina (CA)

(72) Inventor: George Saxby, Regina (CA)

( * ) Notice: Subject to any disclaimer, the term of this patent is extended or adjusted under 35 U.S.C. 154(b) by 0 days.

(21) Appl. No.: 15/596,486

(22) Filed: May 16, 2017

(65) Prior Publication Data

US 2017/0335626 A1 Nov. 23, 2017

Related U.S. Application Data

(60) Provisional application No. 62/337,960, filed on May 18, 2016.

(51) Int. Cl.
*E06C 7/42* (2006.01)

(52) U.S. Cl.
CPC ..... *E06C 7/423* (2013.01)

(58) Field of Classification Search
CPC ..... E06C 7/42; E06C 7/423
See application file for complete search history.

(56) References Cited

U.S. PATENT DOCUMENTS 1,462,505 A * 7/1923 Hunt ..... E06C 7/44 182/201
3,012,628 A * 12/1961 Zumbaum ..... E06C 7/42 182/111
3,025,926 A * 3/1962 Vives ..... E06C 7/42 182/111
3,508,628 A * 4/1970 Conrad ..... E06C 7/423 182/172
4,519,477 A * 5/1985 Ralston ..... E06C 7/423 182/107
4,798,262 A * 1/1989 Margolies ..... E06C 1/20 182/106
4,899,849 A 2/1990 Levi et al.
4,964,488 A 10/1990 Stewart
5,086,876 A * 2/1992 Severson ..... E06C 7/423 182/107
5,715,908 A * 2/1998 Sager ..... E06C 7/44 182/111
5,868,222 A * 2/1999 Charbonneau ..... E06C 7/423 182/107
6,419,047 B1 * 7/2002 Adshead ..... E06C 7/42 182/107
6,672,427 B1 * 1/2004 Sheffield ..... E06C 1/22 182/165

(Continued)

*Primary Examiner* — Colleen M Chavchavadze
(74) *Attorney, Agent, or Firm* — Global Intellectual Property Agency, LLC; Daniel Boudwin

(57) ABSTRACT

A ladder support for attaching on a leg of a ladder. The ladder support attachment includes a pair of support members that removably secure to opposing legs of a ladder. Each support member includes an upper bar affixed to a lower bar about a hinge. The upper bar includes a first fastener on a second end of the upper bar and the lower bar includes a second fastener on a proximal end of the lower bar. The first and second fasteners removably secure to a leg of the ladder. The pair of support members can transition between a first position and a second position, where the first position is the upper and lower bars resting parallel to the leg of the ladder and the second position is the upper and lower bars forming a triangular shape with the leg where the lower bar rests flush with the ground.

1 Claim, 4 Drawing Sheets

(56) References Cited

U.S. PATENT DOCUMENTS

| | | | | |
|---|---|---|---|---|
| 7,093,690 | B2 * | 8/2006 | Swann | E06C 7/46 182/172 |
| 7,163,084 | B1 * | 1/2007 | Blehm | E06C 7/423 182/172 |
| 7,216,742 | B2 * | 5/2007 | Spengler | E06C 1/39 182/172 |
| 8,424,642 | B2 * | 4/2013 | Lietz | E06C 1/06 182/172 |
| 2008/0314682 | A1 * | 12/2008 | Cogswell | E06C 7/423 182/108 |
| 2009/0107765 | A1 * | 4/2009 | Germond | E06C 7/423 182/172 |
| 2010/0038172 | A1 * | 2/2010 | Ralston | E06C 7/18 182/107 |
| 2016/0222729 | A1 * | 8/2016 | Shih | E06C 7/42 |
| 2018/0094488 | A1 * | 4/2018 | Major | E06C 7/423 |

* cited by examiner

LADDER SUPPORT ATTACHMENT

CROSS REFERENCE TO RELATED APPLICATIONS

This application claims the benefit of U.S. Provisional Application No. 62/337,960 filed on May 18, 2016. The above identified patent application is herein incorporated by reference in its entirety to provide continuity of disclosure.

BACKGROUND OF THE INVENTION

The present invention relates to ladder supports. More specifically, it relates to folding ladder supports attachable to a leg of a ladder.

Many people use ladders when attempting to work in areas that are otherwise out of reach. However, ladders can provide a dangerous work environment. Frequently, ladders tip over, spilling their occupant if placed on uneven surfaces or if the user shifts their weight. This can lead to serious injuries to the user from hitting the ground from the height of the ladder. Additionally, current stabilization methods for ladders are bulky and cumbersome, leading to problems in transportation and using the ladder in a tight space. Therefore, a ladder support attachment that secures to a leg of a ladder and can collapse to rest in parallel along the length of the leg of the ladder is needed.

In light of the devices disclosed in the known art, it is submitted that the present invention substantially diverges in design elements from the known art and consequently it is clear that there is a need in the art for an improvement to existing ladder support attachments. In this regard, the instant invention substantially fulfills these needs.

SUMMARY OF THE INVENTION

In view of the foregoing disadvantages inherent in the known types of ladder support attachments now present in the prior art, the present invention provides a ladder support attachment wherein the same can be utilized for providing convenience for the user when stabilizing a ladder.

The present system comprises a pair of support members configured to removably secure to a leg of a ladder, wherein each support member comprises an upper bar hingedly affixed to a lower bar at a first end of the upper bar and a distal end of the lower bar. A first fastener is disposed on a second end of the upper bar and a second fastener is disposed on a proximal end of the lower bar. The first and second fasteners are configured to removably secure to the leg of the ladder. The pair of support members are configured to transition between a first position and a second position, wherein the upper and lower bars rest parallel to the leg in the first position and the upper and lower bars form a triangular shape with the leg in the second position. In the second position, the lower bar is adapted to rests flush with the ground. In some embodiments, the upper and lower bar comprise planar members. In another embodiment, the upper bar comprises a length greater than that of the lower bar. In other embodiments, the first fastener comprises a clamp. In yet another embodiment, the clamp comprises a C-shape and is removably secured to the leg via a tightening bolt. In some embodiments, the second fastener is a bracket comprising a pair of plates configured to rest flush against opposing sides of the leg of a ladder, the pair of plates removably secured to each other by a third and a fourth fastener. In another embodiment, the first fastener is hingedly affixed to the second end. In other embodiments, the second fastener is hingedly affixed to the proximal end. In yet another embodiment, the upper bar and the lower bar are hingedly affixed via a strap hinge.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
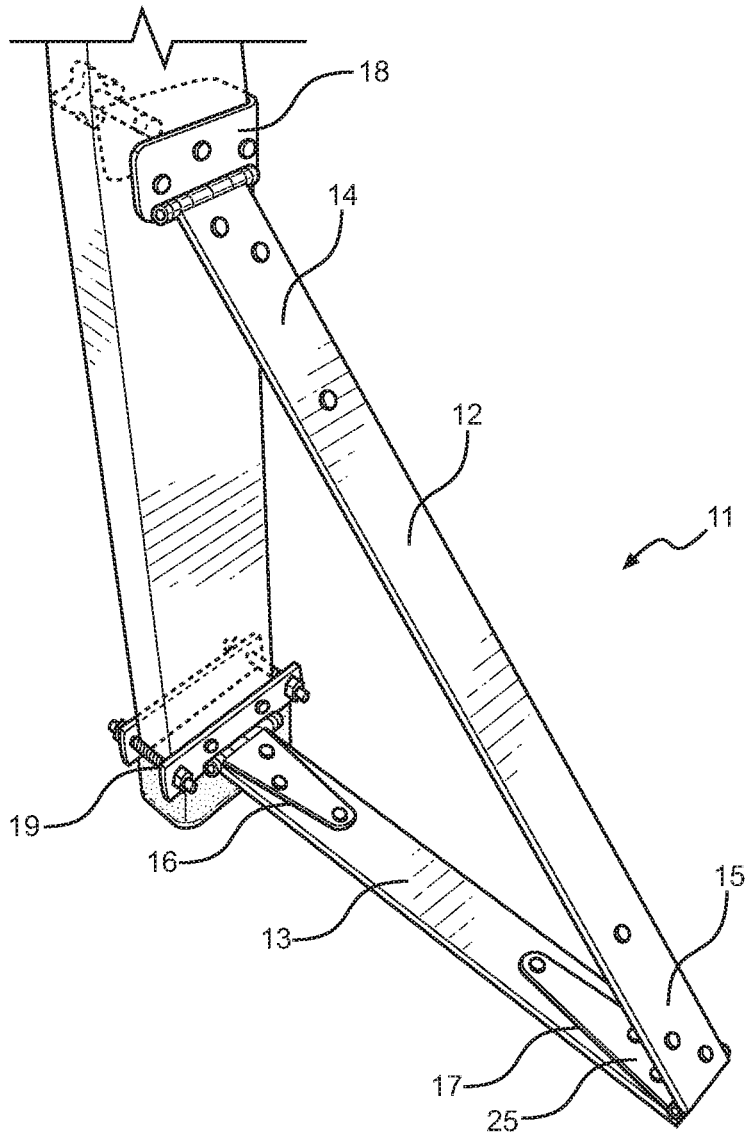
FIG. 1 shows a perspective view of an embodiment of the ladder support attachment attached to a leg of a ladder.

Reference is made herein to the attached drawings. Like reference numerals are used throughout the drawings to depict like or similar elements of the ladder support attachment. The figures are intended for representative purposes only and should not be considered to be limiting in any respect.

Referring now to FIG. 1, there is shown a perspective view of an embodiment of the ladder support attachment attached to a leg of a ladder. The ladder support attachment a pair of support members 11 each removably securable to opposing legs of a ladder 20. In the illustrated embodiment, one of the pair of support members 11 is shown. The pair of support members 11 comprise an upper bar 12 having a first end 15 and a second end 14 and a lower bar 13 having a proximal end 16 and a distal end 17. In the illustrated embodiment, the upper bar 12 and the lower bar 13 comprise planar members. In this way, the upper and lower bars 12, 13 can rest flush against the leg 20 and the ground and provide minimal protrusion for ease of transport and storage. In some embodiments, the upper bar 12 comprises a length greater than that of the lower bar 13, allowing increased stability as the upper bar 12 is disposed higher on the leg 20 when the lower bar 13 to rest flush against the ground when the pair of support members 11 are deployed.

The upper bar 12 is hingedly affixed to a lower bar 13, wherein the upper bar 12 is affixed to the lower bar 13 at the first end 15 and the distal end 17. In the illustrated embodiment, the upper bar 12 and the lower bar 13 are hingedly affixed via a strap hinge 25, however any appropriate hinge can be used, including but not limited to butt hinges and flexible straps. This allows the pair of support members 11 to be deployed to provide support to the ladder and stowed against each leg 20.

A first fastener 18 is disposed on a second end 14 of the upper bar 12. The first fastener 18 is configured to removably secure to the leg 20 of a ladder. Similarly, a second fastener 19 is disposed on a proximal end 16 of the lower bar 13. The second fastener 19 is configured to removably secure to the leg 20. In the illustrated embodiment, the first and second fasteners 18, 19 are hingedly affixed to the upper and lower bars 12, 13 respectively. This allows the first and second fasteners 18, 19 greater freedom of movement, allowing the pair of support members 11 to rest flush against the leg 20 when stowed.

Figure 2A:
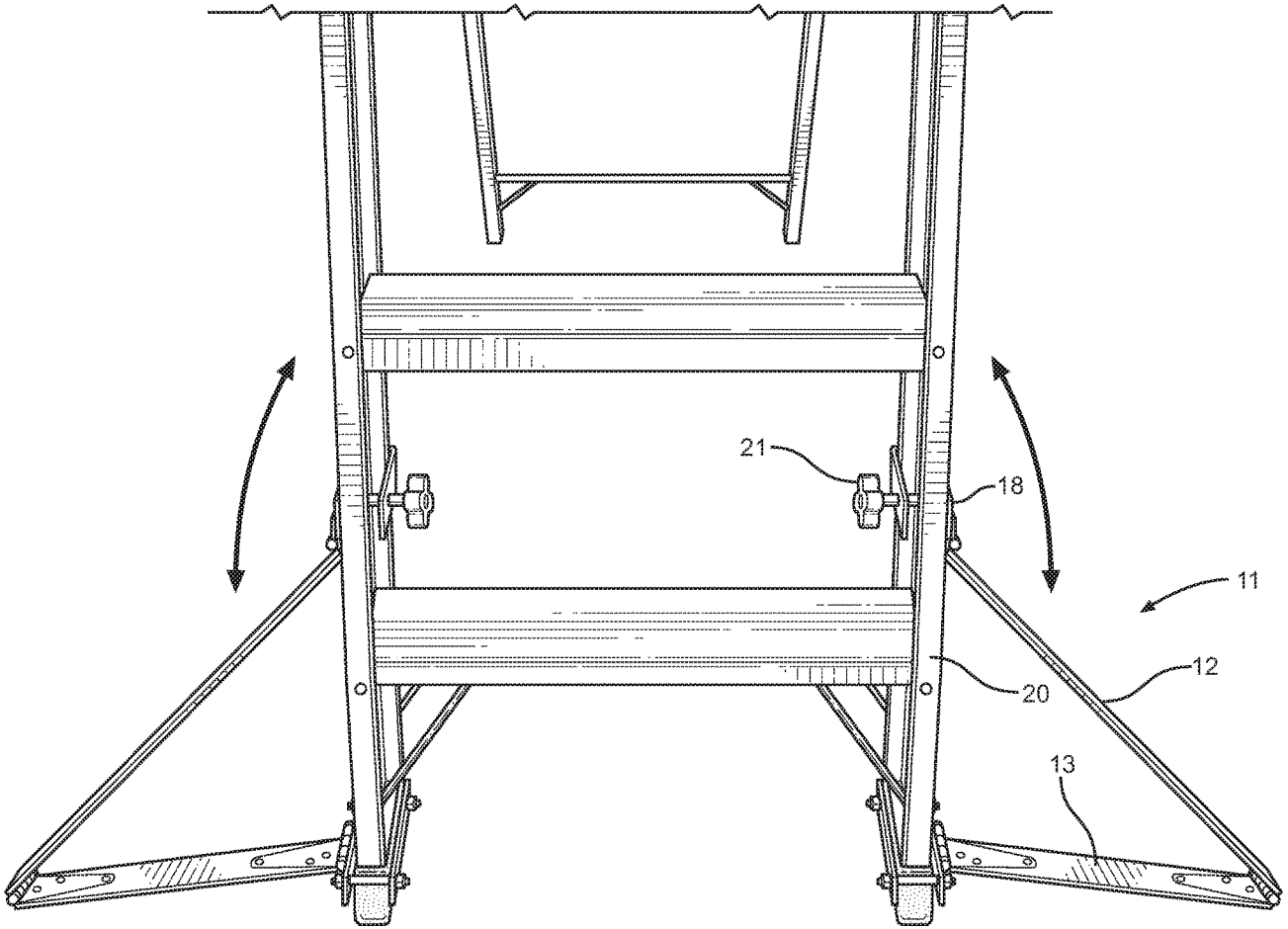
FIG. 2A shows a perspective view of an embodiment of the ladder support attachment extended in the second position.
Figure 2B:
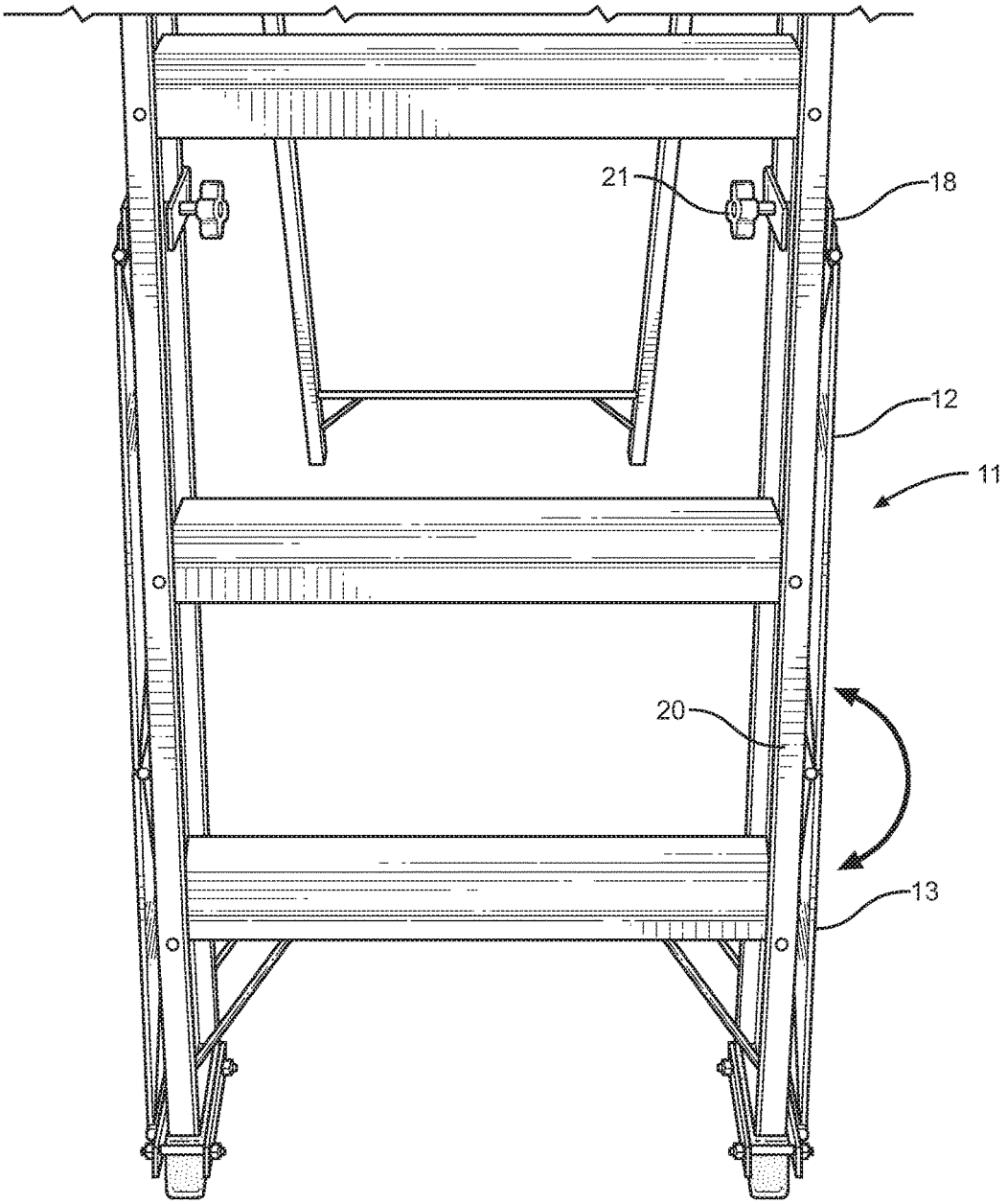
FIG. 2B shows a perspective view of an embodiment of the ladder support attachment retracted in the first position.

Referring now to FIGS. 2A and 2B, there is shown a perspective view of an embodiment of the ladder support attachment extended in the second position and a perspective view of an embodiment of the ladder support attachment retracted in the first position, respectively. In the illustrated embodiment, the pair of support members 11 are removably secured to opposing legs 20 of a ladder. As shown in FIG. 2A, the pair of support members 11 are configured to deploy in a second position, wherein the upper and lower bars 12, 13 form a triangular shape with the leg 20 such that a portion of the lower bar 13 rests flush with the ground. The second position allows the pair of support members 11 to provide stability to the ladder in order to prevent tipping to either side due to shifts of weight or uneven surfaces.

In the illustrated embodiment of FIG. 2B, the pair of support members 11 are shown in the first position, wherein the upper and lower bars 12, 13 rest parallel to the leg 20. The first position allows the pair of support members 11 to be folded in a more convenient and less intrusive form factor for greater ease in transport and storage. Additionally, should the user need to place one leg 20 against a wall or other surface, the upper and lower bars 12, 13 on that side can be folded into the first position shown, while the opposing support member 11 is deployed in the second position for additional stability. In order to transition from the first position to the second position, a tightening bolt 21 of the illustrated embodiment is loosened to allow the first fastener 18 to slide along the leg 20. As the first fastener 18 in the illustrated embodiment comprises a C-shaped clamp, it is possible that the first fastener 18 would be prevented from sliding lower along the leg 20 due to the C-shaped clamp of the first fastener 18 encountering a ladder rung. Should a ladder rung prevent the motion, the first fastener 18 can be removed from the leg 20, such that the leg 20 is no longer within the C-shaped clamp, and replaced on the other side of the rung.

Figure 3A:
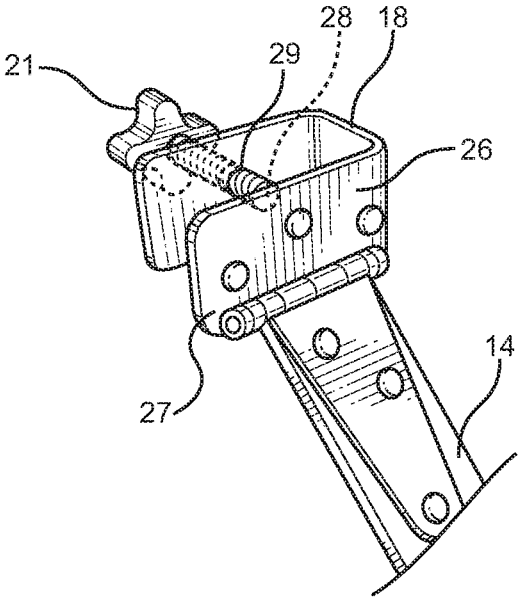
FIG. 3A shows a perspective view of an embodiment of the first fastener of the ladder support attachment.
Figure 3B:
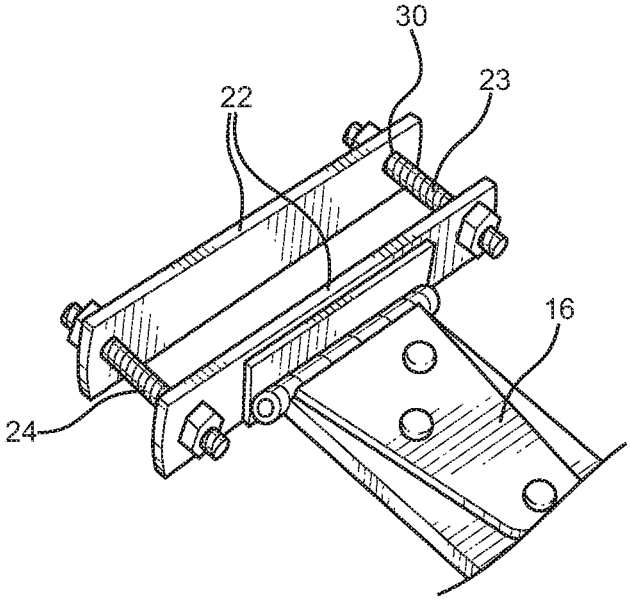
FIG. 3B shows a perspective view of an embodiment of the second fastener of the ladder support attachment.

Referring now to FIGS. 3A and 3B, there is shown a perspective view of an embodiment of the first fastener of the ladder support attachment and a perspective view of an embodiment of the second fastener of the ladder support attachment, respectively. In the illustrated embodiment of FIG. 3A, the first fastener 18 comprises a clamp having a C-shape disposed on second end 14 of the upper bar. The second end 14 of the upper bar is affixed along a lower edge 27 of a lateral side 26 of the clamp. The tightening bolt 21 is configured to removably secure the C-shaped clamp to the leg of a ladder. The C-shaped clamp comprises an aperture 29 adapted to receive a threaded end 28 of the tightening bolt 21. The threaded end 28 is configured to engage the leg 20 as the tightening bolt 21 is rotated. In the illustrated embodiment, the first fastener 18 is hingedly affixed to the second end 14. This hinged configuration allows for greater flexibility in the pair of support members when moving from a first position to a second position.

In the illustrated embodiment of FIG. 3B, the second fastener 19 comprises a pair of plates 22 configured to rest parallel to each other flush against either side of the leg of a ladder. Each of the pair of plates 22 comprise a pair of openings 30 disposed on opposing ends of the pair of plates 22 configured to receive a fastener therethrough. In the illustrated embodiment, one of the pair of plates 22 is permanently and hingedly affixed to the proximal end 16 of the lower bar. The pair of plates 22 are then secured to the leg of the ladder via a third fastener 23 and a fourth fastener 24. In the illustrated embodiment, the third and fourth fasteners 23, 24 comprise bolts secured by a nut, however any suitable fastener including screws, pins, and the like are acceptable. This embodiment provides fixed securement of the lower bar 13 to the leg 20, such that when a force is applied to the lower bar 13, the lower bar 13 remains stationary relative to its initial position on the leg 20.

In one use, a user removably secures the pair of support members 11 to opposing legs 20 of the ladder. The second fastener 19 is secured to a lower section of a leg 20 of a ladder, and the first fastener 18 is secured to a higher section of the leg 20. In the case of the illustrated embodiment of FIG. 3, the C-shaped first fastener 18 is placed around the leg 20 and the tightening bolt 21 is tightened to removably secure the first fastener 18 around the leg 20. Additionally, the second fastener 19 is removably secured to the leg 20 by placing the pair of plates 22 on either side of the leg 20 and securing them in place with the third and fourth fasteners 23, 24. In the illustrated embodiment of FIG. 3, the third and fourth fasteners 23, 24 comprise bolts disposed through apertures present on the pair of plates 22. When the user wishes to use the ladder with the pair of support members 11, the user places the ladder in the desired location and lowers the pair of support members 11 into the second position as shown in FIG. 2A. The tightening bolt 21 is loosened, and the first fastener 18 lowered along the leg 20 to a location that allows the lower bar 13 to rest flush against the ground. The tightening bolt 21 is tightened to secure the first fastener 18 in that position. In this position, the upper bar 12 provides stability to the ladder. When used in an open area, this is done for both of the pair of support members 11, however, if the user wishes to use the ladder against a wall or other surface, only one of the support members 11 is placed in the second position. In this way, the ladder can be placed flush against a wall surface. When the user is finished using the ladder, the process is reversed, in that the tightening bolt 21 is loosened and the first fastener 18 raised until the pair of support members 11 are in the first position parallel to the leg 20 of the ladder. The ladder can then be easily transported and stored for future use.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ladder support attachment, consisting of:

a pair of support members configured to removably secure to opposing legs of a ladder;

wherein each support member consists of an upper bar hingedly affixed to a lower bar at a first end of the upper bar and a distal end of the lower bar;

a first fastener disposed on a second end of the upper bar;

a second fastener disposed on a proximal end of the lower bar;

wherein the first fastener consists of a C-shaped clamp removably securable to the leg via a tightening bolt having a threaded end;

wherein the clamp further consists of an aperture configured to receive the tightening bolt therethrough, such that when the tightening bolt is rotated, the threaded end engages with the leg;

wherein the first and second fasteners are configured to removably secure to a leg of the opposing legs of the ladder;

wherein the second fastener consists of a pair of plates configured to rest flush against opposing sides of the leg of a ladder, the pair of plates removably secured to each other by a third and fourth fastener;

wherein the third and fourth fasteners extend perpendicularly through the pair of plates on opposing ends thereof, such that the third and fourth fasteners are configured to rest against a front side of the leg and a rear side of the leg, respectively;

wherein the pair of support members are configured to transition between a first position and a second position;

wherein the upper and lower bars rest parallel to the leg in the first position and the upper and lower bars form a triangular shape with the leg, wherein a portion of the lower bar rests flush with the ground, in the second position.

* * * * *